United States Patent [19]

Jacobs

[11] 4,090,692

[45] May 23, 1978

[54] CABLE GATHERING AND ORIENTING ASSEMBLY

[75] Inventor: Lawrence O'Quinn Jacobs, Richmond, Va.

[73] Assignee: Plastic Products, Inc., Richmond, Va.

[21] Appl. No.: 734,530

[22] Filed: Oct. 21, 1976

[51] Int. Cl.[2] ..... B66C 23/60

[52] U.S. Cl. ..... 254/141; 254/190 R

[58] Field of Search ..... 254/141, 194, 195, 196, 254/197, 192; 248/72, 228, 226.1; 24/81 CC, 81 PB, 263 A, 263 LS

[56] References Cited

U.S. PATENT DOCUMENTS

| | | | |
|---|---|---|---|
| 1,771,059 | 7/1930 | Regan | 254/192 |
| 1,791,008 | 2/1931 | Statler et al. | 254/192 |
| 2,877,974 | 3/1959 | Estes | 248/2328 |

*Primary Examiner*—Lawrence J. Oresky
*Assistant Examiner*—Donald W. Underwood
*Attorney, Agent, or Firm*—Norman B. Rainer

[57] ABSTRACT

A multifunctional assembly is provided which receives a first group of cables from one direction and a second group of cables from the opposite direction, reverses the direction of one of said groups of cables, and forwards all of said cables as a single combined group of parallel, coplanar, codirectional cables. The assembly is provided with adjustable clamping means to facilitate attachment to an overhead structural beam.

2 Claims, 4 Drawing Figures

CABLE GATHERING AND ORIENTING ASSEMBLY

BACKGROUND OF THE INVENTION

This invention relates to a pulley apparatus adapted to reverse the direction of a first plurality of cables and combine them with a second plurality of cables to provide a combined oriented plurality of coplanar, parallel and codirectional cables. The apparatus is specially adapted for use in a system for raising a flexible curtain.

Large foldable ceiling-hung curtains fabricated of flexible textile or film materials or of a multitude of rigid panels find use in various applications. They may be employed for the purpose of controllably obscuring objects or areas, such as when used as stage curtains or curtains for concealment of projector screens, or curtains to exclude light. Such curtains may also be employed for acoustic insulation, fire protection, air flow restraint, and space dividers as when used to divide large areas such as gymnasiums, meeting halls or restaurants into smaller separated areas. Said curtains are generally hung from ceilings or ceiling support beams, and generally extend to the floor in their fully deployed condition.

One manner of storage and deployment of such curtains has involved overhead suspensions or tracks which permit the curtain to be drawn in the horizontal direction so that the gathered curtain, containing vertical folds, can be stored against a wall of the room. Such manner of storage, however, occupies a certain amount of floor space, and could interfere with activities requiring the use of said space or adjoining areas.

Another mode of deployment and storage of ceiling-hung curtains involves a lifting system wherein the curtain is gathered in horizontal folds and drawn to the ceiling. Such ceiling storage does not occupy floor space or interfere with the usual activities in a room or gymnasium area. Although the ceiling system of curtain storage has its advantages, installation is more difficult than in the case of horizontally drawn, wall-stored curtains.

A ceiling-stored curtain system requires means for holding the top of the curtain near the ceiling, means such as cables attached to the bottom of the curtain for lifting, guide means such as grommets associated with the curtain to insure proper folding of same, and a lifting mechanism such as a winch-operated drum which is preferably motor driven. Because of the generally large size of ceiling-hung curtains, a multitude of lifting cables, suitably spaced along the curtain is usually required. This necessitates the use of considerable amounts of cable, thereby increasing the cost of such installations. Another problem encountered is that of entanglement of the many cables, particularly en route to and on the winch-operated drum.

It is an object of the present invention to provide apparatus for simplifying the installation and operation of a vertically lifting curtain. It is another object to provide a specialized pulley apparatus useful in achieving several functions in the installation and operation of a vertically lifting curtain. It is a still further object of this invention to minimize the amount of cable required and the entanglement of same in a vertically lifting, ceiling-hung curtain system. Other objects and advantages will become apparent hereinafter.

SUMMARY OF THE INVENTION

The ojects of the present invention are accomplished in general by providing a multi-wheeled cable handling assembly comprising horizontally adjustable mounting means comprising a pair of opposed angle bars having an upper, horizontally disposed leg and a vertical leg, said angle bars being interconnected by at least two parallel and horizontally disposed threaded rods which engage the vertical leg of each angle bar in at least two different heights along same, a plurality of grooved wheels mounted on one of said rods for rotation in vertical planes, the upper extremities of said wheels being below said horizontal legs, a pair of straight elongated guard surfaces coextensive with said rods positioned one above the other in a vertical plane and located closely above and below said wheels, and guide means horizontally displaced from said wheels and adapted to facilitate passage of a plurality of cables in a direction vertical to said rods.

DETAILED DESCRIPTION OF THE INVENTION

Figure 1:
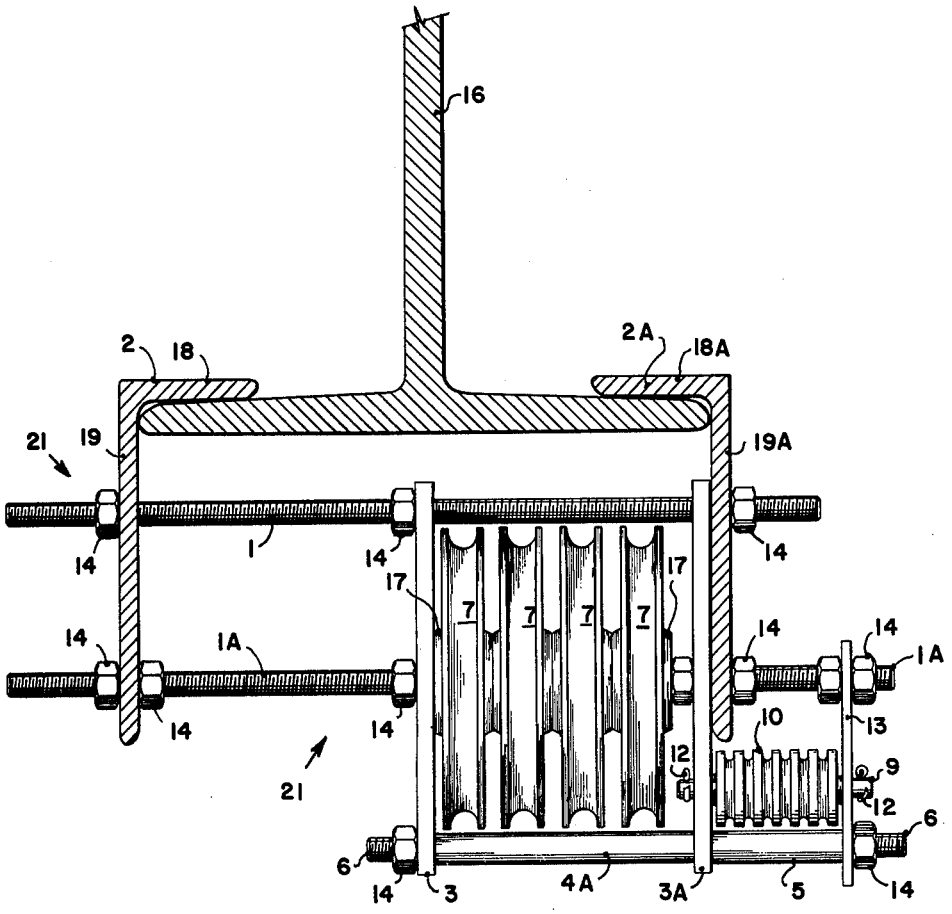
FIG. 1 is a side view of a cable handling assembly of the present invention.

Referring to FIG. 1, a cable handling assembly 21 is mounted on overhead I beam 16 by means of opposed angle bars 2 and 2A, each consisting of horizontal legs 18 and 18A, and vertical legs 19 and 19A. Said angle bars are locked into clamping position by virtue of engagement with a pair of upper threaded rods 1 and lower threaded rod 1A which pass through close-fitting holes in vertical legs 19 and 19A and are fastened by associated threaded nuts 14. Grooved pulley wheels 7 are positioned on lower threaded rod 1A in a manner such that the bearing hubs 17 of said wheels are in contact.

Figure 2:
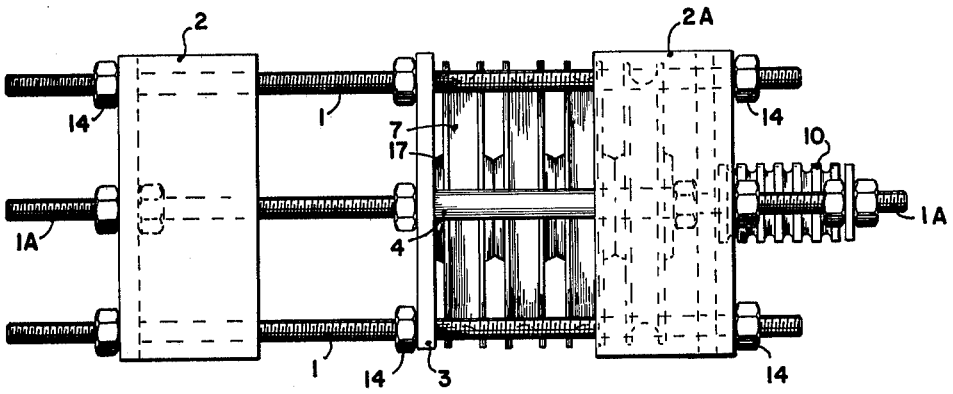
FIG. 2 is a top view of the assembly of FIG. 1.
Figure 3:
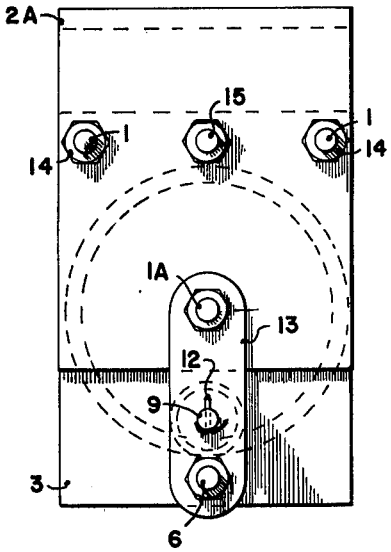
FIG. 3 is an end view of the assembly of FIG. 1.

As shown in FIGS. 2 and 3, the top extremities of said wheels 7 are located just below upper sleeved rod 15 provided with sleeve 4. Said sleeved rod 15 is supported by penetration through close-fitting holes in said plates 3 and 3A and vertical leg 19A, and is locked in place by threaded nuts 14. The ends of rod 15 terminate at nuts 14 and thus the rod ends do not appear in FIG. 2. The lower-most extremities of the wheels 7 are positioned in close proximity to lower sleeved rod 6 containing sleeve 4A, and supported by side plates 3 and 3A.

A guide means represented by multi-grooved roller 10 is rotatably mounted on axle 9 supported by penetration through close-fitting holes in side plate 3A and support strap 13 depending from the extremity of threaded rod 1A. Cotter pins 12 maintain proper positioning of axle 9. Said roller 10 is positioned closely adjacent sleeve 5 mounted on the portion of lower sleeved rod 6 extending beyond side plate 3A.

Figure 4:
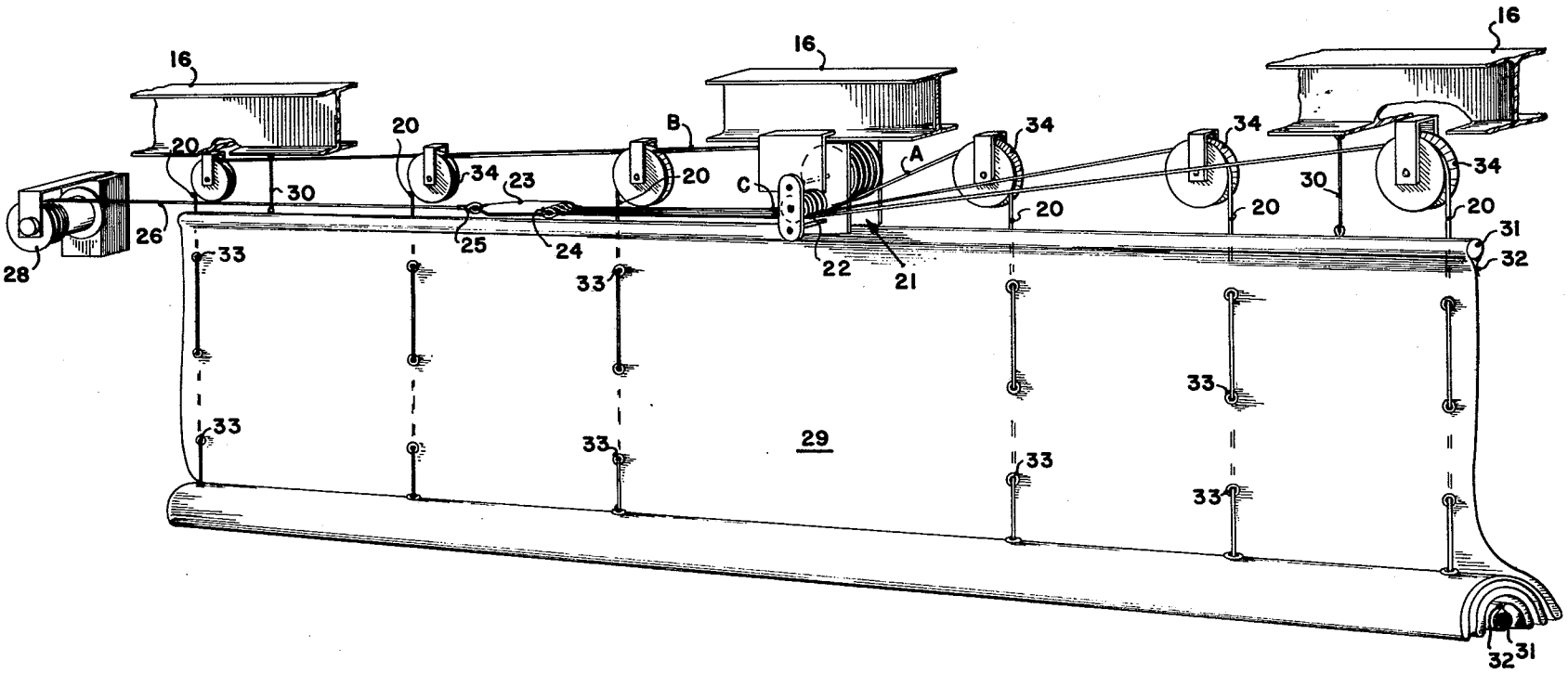
FIG. 4 is a perspective view illustrating the cable handling assembly in association with a vertically lifting curtain.

As shown in FIGS. 1, 2 and 3, the rod members 1, 1A, 15 and 6 are all horizontally disposed in parallel juxtaposition. The vertical legs 19 and 19A, side plates 3 and 3A, and support strap 13 are also in parallel juxtaposition and perpendicular to the aforesaid rod members. The spacing between the wheels 7 and sleeves 4 and 4A, and the spacing between the bottom of roller 10 and sleeve 5 is such that cables 20, as shown in FIG. 4, will be constrained with respect to lateral movement during their unimpeded passage between the respective rotating member and associated sleeve. The several sleeves function as bearing surfaces which contact the cables during their passage, thereby ensuring that the cables follow the prescribed path. The sleeves also function as spacers to maintain proper positioning and alignment of side plates 3 and 3A and support strap 13.

Angle bar 2A contains a hole at its upper extremity to accomodate sleeved rod 15. Otherwise, angle bars 2 and 2A are identical. Side plate 3A contains a hole at its lower extremity to accomodate axle 9. Otherwise, side plates 3 and 3A are identical. It is to be noted, especially in FIG. 3, that the center axes of upper sleeved rod 15, lower threaded rod 1A, axle 9, and lower sleeved rod 6 all lie within the same vertical plane.

The various rods, plates and angle bars are preferably fabricated from iron or steel stock. The pulley wheels 7 and roller 10 may be fabricated from steel, aluminum, magnesium, or other suitable metals or alloys thereof, or may be fabricated from synthetic polymeric material. The sleeves 4, 4A and 5 are dimensioned so as to closely fit onto the underlying rod. In some embodiments the sleeves may be free to rotate on said rods. The sleeves may be fabricated of metals such as copper and other relatively soft metals, or plastics. Since the cables employed are generally of steel construction, it is preferable that materials utilized for fabrication of the sleeves be reasonably resistant to abrasive degradation.

The term "cable" as used herein is interdated to denote any strong, thin, flexible strand; generally a multifilamentary structure having a twisted or braided configuration. Suitable cables may be fabricated of steel wire, fiberglass, or high tenacity continuous filaments of synthetic polymeric material such as polyester or polyamide. The cable may be coated or jacketed with an adherent abrasion resistant material.

The cable guide means exemplified in the drawings consists of a multi-channeled roller 10, the rotation and positioning of which may be facilitated by bearings, bushings and the like. Alternative guide means may be utilized such as separately rotatable wheels, or stationary eyes, combs, or other equivalent structures. It is important that the guide means be positioned so as to deliver cables at essentially the same level as the bottoms of pulley wheels 7.

Although the embodiment of the invention illustrated in the drawings has two side plates 3 and 3A, side plate 3A may in certain embodiments be replaced by a modified form of angle bar 2A which can incorporate the features and functions of said side plate 3A. Similarly, side plate 3 can be eliminated in certain embodiments by utilization of longer lengths of sleeved rods 15 and 6 which would engage with a modified form of angle bar 2. In such cases, a threaded nut 14 abuting against the outermost of the wheels 7 may serve to hold the several pulley wheels together.

In installing the apparatus of the present invention into a curtain system, the apparatus is positioned along the length of an overhead ceiling I beam at a site such that approximately equal numbers of curtain-lifting cables will approach it from either direction. Said cables are preferably advanced from lifting pulleys mounted on the same I beam, suitable lifting pulleys being those described in copending U.S. Patent Application Ser. No. 734,518, entitled "Pulley Lift Assembly and Curtain System Employing Same", filed of even date herewith by the same inventor. The pulley wheels 7 are positioned under the I beam but displaced to one side thereof, as shown in FIG. 1. The cable guide means protrudes from under said I beam. Once positioned, angle bars 2 and 2A are tightened onto the overhead beam by means of threaded nuts 14 abutting against the outside surfaces of vertical legs 19 and 19A.

An exemplary manner of function of the cable handling assembly of this invention in a vertically lifting curtain system is illustrated in FIG. 4 wherein a rectangular flexible curtain 29, containing pipes 31 positioned within seamed loops 32, is suspended from I beam 16 by means of hangers 30 which engage upper pipe 31. Lifting cables 20, attached to lower pipe 31 at spaced intervals, extend vertically through grommetts 33 in curtain 29 and enter onto the respective lifting pulleys 34. A first group of cables, designated group A, approaches cable handling assembly 21 from one direction, and a second group of cables, designated group B, approaches the cable handling assembly from a direction opposite to the direction of the cables of group A. The cables of group A pass through guide means 22. The cables of group B pass under sleeve 4, entering onto individual pulley wheels 7, and ride in the grooves of said wheels for essentially 180° of turning angle, emerging at a point underneath said wheels and above sleeve 4A. The cables from both groups A and B are consequently brought into a single group of parallel, coplanar codirectional cables, designated as C. The cables of group C then individually attach to the large end 24 of clew plate 23. A single pulling cable 26 leads from the small end 25 of clew plate 23 to winch operated drum 28.

To raise curtain 29, winch-operated drum 28 winds pulling cable 26, causing clew plate 23 to travel a horizontal distance equal to the height the curtain is raised. Because only one pulling cable winds onto said drum instead of the multitude of lifting cables 20, there is less likelihood of entanglements occurring on said drum. The use of the single cable 26 also minimizes the total length of costly cable required for the curtain system. Since the cable reversing mechanism is located on the ceiling, and the lifting cables travel a horizontal path along the ceiling very little wall space is sacrificed to accommodate components of the curtain-lifting system. Lowering of a raised curtain is accomplished merely by reversing the action of winch-operated drum 28.

Having thus described my invention, What is claimed is:

1. A multi-wheeled cable gathering and orienting assembly comprising horizontally adjustable mounting means comprising a pair of opposed angle bars, each having an upper, horizontally disposed leg and a vertical leg, and at least two parallel horizontally disposed threaded rods which interconnect said angle bars by engagement with the vertical leg of each in at least two different elevations along same, , a plurality of wheels having peripheral grooves and mounted on one of said rods for rotation in vertical planes, the upper extremities of said wheels being below said horizontal legs, first and second straight elongated guard surfaces coextensive with said rods, positioned one above the other in a vertical plane and located closely above and below said wheels respectively, said wheels being each adapted to receive a horizontally disposed moving cable entering said groove under said first guard surface to ride in said groove for essentially 180° of turning angle and emerge underneath said wheel and above said second guard surface, and guide means comprising a multi-grooved roller horizontally displaced from said wheels and mounted above a third guard surface coaxial with said second guard surface, and adapted to facilitate passage of a plurality of cables in a direction vertical to said rods and co-planar and codirectional with said cables emerging from said wheels.

2. The assembly of claim 1 wherein said guard surface below said roller is essentially an extension of the guard surface under said wheels.

* * * * *